US010731881B2

(12) United States Patent
Amr et al.

(10) Patent No.: US 10,731,881 B2
(45) Date of Patent: Aug. 4, 2020

(54) FAN COIL UNIT WITH SHROUDED FAN

(71) Applicant: Carrier Corporation, Farmington, CT (US)

(72) Inventors: Yehia M. Amr, Seattle, WA (US); Ryan K. Dygert, Cicero, NY (US); Peter R. Bushnell, Cazenovia, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 256 days.

(21) Appl. No.: 14/759,805

(22) PCT Filed: Jan. 6, 2014

(86) PCT No.: PCT/US2014/010280

§ 371 (c)(1),
(2) Date: Jul. 8, 2015

(87) PCT Pub. No.: WO2014/109970

PCT Pub. Date: Jul. 17, 2014

(65) Prior Publication Data

US 2015/0354841 A1 Dec. 10, 2015

Related U.S. Application Data

(60) Provisional application No. 61/751,639, filed on Jan. 11, 2013.

(51) Int. Cl.
*F24F 7/06* (2006.01)
*F04D 13/06* (2006.01)
(Continued)

(52) U.S. Cl.
CPC ..... *F24F 7/065* (2013.01); *F04D 13/06* (2013.01); *F04D 19/002* (2013.01);
(Continued)

(58) Field of Classification Search
CPC ..... F24F 7/065; F24F 1/0029; F04D 13/06; F04D 19/002; F04D 29/326; F04D 29/522; F04D 29/544
(Continued)

(56) References Cited

U.S. PATENT DOCUMENTS 5,121,613 A 6/1992 Cox et al.
5,473,123 A 12/1995 Yazici et al.
(Continued)

FOREIGN PATENT DOCUMENTS

CN 1374460 10/2002
CN 1616832 5/2005
(Continued)

OTHER PUBLICATIONS

Notification of Transmittal of the International Search Report and the Written Opinion of the International Searching Authority, or the Declaration for PCT/US2014/010280; dated Apr. 2, 2014; dated Apr. 11, 2014; 10 pages.
(Continued)

*Primary Examiner* — Steven B McAllister
*Assistant Examiner* — Allen R Schult
(74) *Attorney, Agent, or Firm* — Cantor Colburn LLP

(57) ABSTRACT

An air handling unit for use with an air conditioning system is provided including a housing duct through which air is circulated. A vane-axial flow fan circulates air through the housing duct. The fan includes an impeller having a plurality of fan blades extending therefrom and an axis of rotation arranged substantially in-line with a flow path of the air. A heat exchanger assembly is arranged within the housing duct in a heat transfer relationship with the air circulating through the housing duct.

18 Claims, 16 Drawing Sheets

(51) Int. Cl.

| | |
|---|---|
| ***F04D 29/52*** | (2006.01) |
| ***F04D 19/00*** | (2006.01) |
| ***F24F 1/0029*** | (2019.01) |
| ***F04D 29/32*** | (2006.01) |
| ***F04D 29/54*** | (2006.01) |
| ***F04D 29/16*** | (2006.01) |
| ***F24F 13/20*** | (2006.01) |

(52) U.S. Cl.
CPC ..... *F04D 29/164* (2013.01); *F04D 29/326* (2013.01); *F04D 29/522* (2013.01); *F04D 29/544* (2013.01); *F24F 1/0029* (2013.01); *F24F 2013/205* (2013.01)

(58) Field of Classification Search
USPC ..... 454/233
See application file for complete search history.

(56) References Cited

U.S. PATENT DOCUMENTS

| | | | | |
|---|---|---|---|---|
| 5,473,124 | A | 12/1995 | Yazici et al. | |
| 5,489,186 | A * | 2/1996 | Yapp | F01D 5/141 415/208.3 |
| 5,924,300 | A | 7/1999 | Fromm et al. | |
| 5,979,595 | A | 11/1999 | Harris | |
| 5,983,888 | A | 11/1999 | Anselmino et al. | |
| 6,058,718 | A | 5/2000 | Forsberg et al. | |
| 6,564,864 | B2 | 5/2003 | Carter et al. | |
| 6,574,980 | B1 | 6/2003 | Morrison | |
| 6,668,970 | B1 | 12/2003 | Lee | |
| 6,688,966 | B2 | 2/2004 | Akhtar | |
| 6,892,851 | B2 | 5/2005 | Lee | |
| 7,003,972 | B2 | 2/2006 | Eom et al. | |
| 7,086,825 | B2 * | 8/2006 | Wang | F04D 29/164 415/173.6 |
| 7,142,424 | B2 | 11/2006 | Malone et al. | |
| 7,323,065 | B2 | 1/2008 | Fencl et al. | |
| 7,372,698 | B1 | 5/2008 | Tilton et al. | |
| 7,565,814 | B2 | 7/2009 | Yamashita et al. | |
| 7,721,560 | B2 | 5/2010 | Carpenter | |
| 7,721,789 | B2 | 5/2010 | Ueda et al. | |
| 7,811,055 | B2 | 10/2010 | Stommel et al. | |
| 7,971,451 | B2 | 7/2011 | Yabu et al. | |
| 8,127,566 | B2 | 3/2012 | Hammond | |
| 8,146,376 | B1 | 4/2012 | Williams et al. | |
| 8,171,986 | B2 | 5/2012 | Klein | |
| 2006/0216147 | A1 * | 9/2006 | Park | F04D 29/164 415/220 |
| 2010/0326624 | A1 | 12/2010 | Hancock | |
| 2011/0192188 | A1 | 8/2011 | Nickey et al. | |
| 2012/0018117 | A1 | 1/2012 | Yamada et al. | |
| 2012/0125033 | A1 | 5/2012 | Tanno et al. | |
| 2012/0211198 | A1 | 8/2012 | Kinkel | |
| 2013/0168064 | A1 * | 7/2013 | Akiyoshi | F24F 1/0011 165/121 |

FOREIGN PATENT DOCUMENTS

| | | |
|---|---|---|
| CN | 101668678 | 3/2010 |
| CN | 102308153 | 1/2012 |
| DE | 102008046508 | 3/2010 |
| EP | 0746689 B1 | 4/2002 |
| EP | 1281544 B1 | 1/2004 |
| EP | 1568944 A1 | 8/2005 |
| EP | 2233863 A2 | 9/2010 |
| EP | 2395290 A1 | 12/2011 |
| EP | 2416076 A2 | 2/2012 |
| EP | 2455660 A2 | 5/2012 |
| EP | 2472190 A1 | 7/2012 |
| JP | H0526471 A | 2/1993 |
| JP | H05251883 A | 9/1993 |
| JP | H05280766 A | 10/1993 |
| JP | 2005241018 A | 9/2005 |
| JP | 2006194555 A | 7/2006 |
| WO | 9854522 A1 | 12/1998 |
| WO | 0028266 A1 | 5/2000 |
| WO | 2008143603 A1 | 12/2006 |

OTHER PUBLICATIONS

Chinese Office Action, Chinese Application No. 201480004484.5, dated Apr. 26, 2017, State Intellectual Property Office, P.R. China; Office Action Translation 8 pages.

* cited by examiner

FAN COIL UNIT WITH SHROUDED FAN

CROSS-REFERENCE TO RELATED APPLICATIONS

This application claims the benefit of U.S. provisional patent application Ser. No. 61/751,639 filed Jan. 11, 2013, the entire contents of which are incorporated herein by reference.

BACKGROUND OF THE INVENTION

The invention relates generally to air conditioning systems and, more particularly, to a fan for moving air through a ducted portion of an air conditioning system.

Conventional air conditioning systems may be sold as a single package unit including a condensing section and an air handling section, or as a split system unit in which the air handling unit is installed within the building and a condensing unit is installed outside of the building. Conventional air handling units rely almost exclusively on blowers, such as a forward curve blower for example, to circulate air through the air handling unit. Forward curve blowers, however, have a limited static efficiency and may incur significant system losses depending on their installation due to excess turning required of the airstream.

BRIEF DESCRIPTION OF THE INVENTION

According to one aspect of the invention, an air handling unit for use with an air conditioning system is provided including a housing duct through which air is circulated. A vane-axial flow fan circulates air through the housing duct. The fan includes an impeller having a plurality of fan blades extending therefrom and an axis of rotation arranged substantially in-line with a flow path of the air. A heat exchanger assembly is arranged within the housing duct in a heat transfer relationship with the air circulating through the housing duct.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 10:
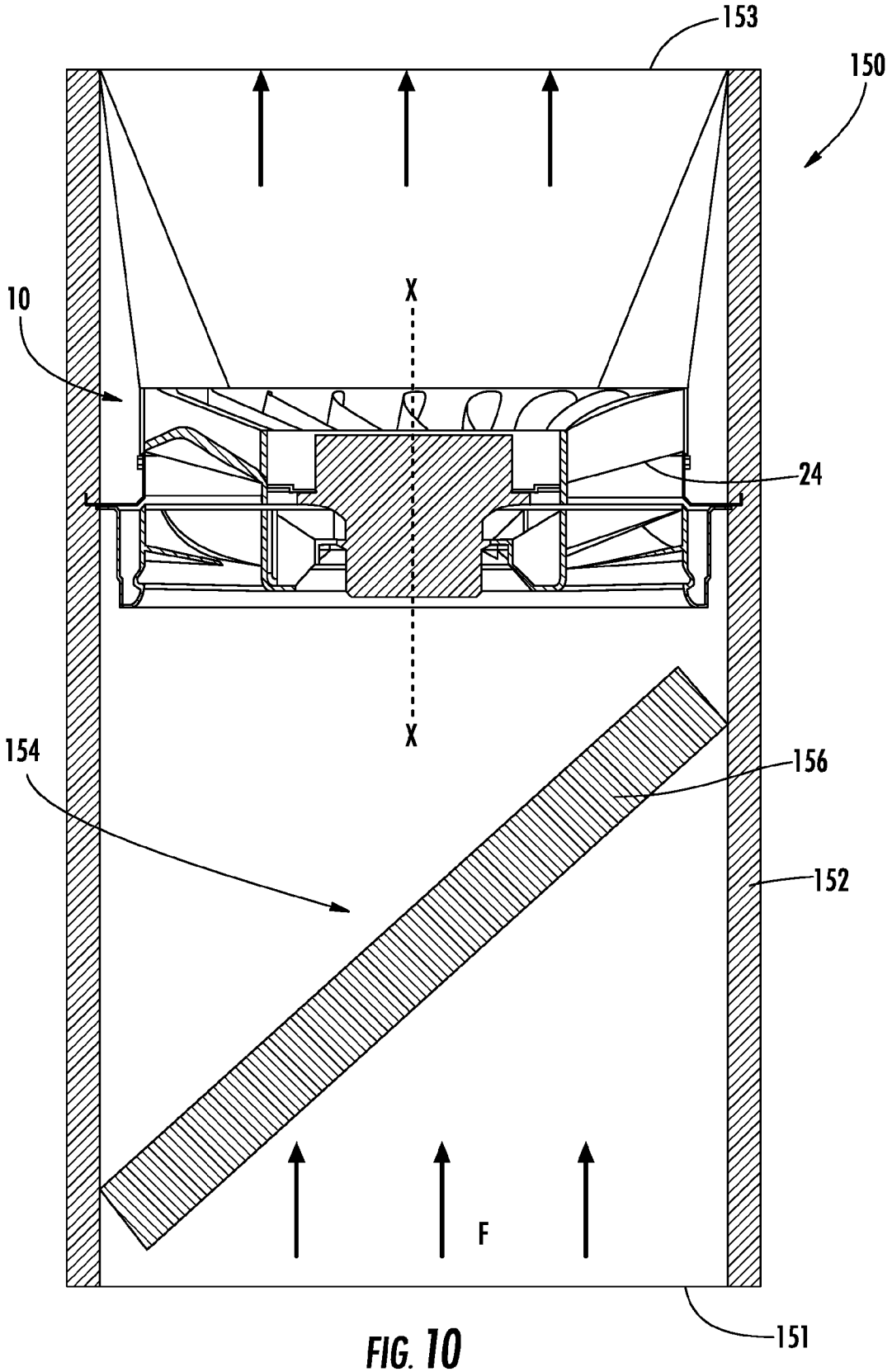
FIG. 10 is a cross-section of an air handling unit of an air conditioning system according to an embodiment of the invention.
Figure 11:
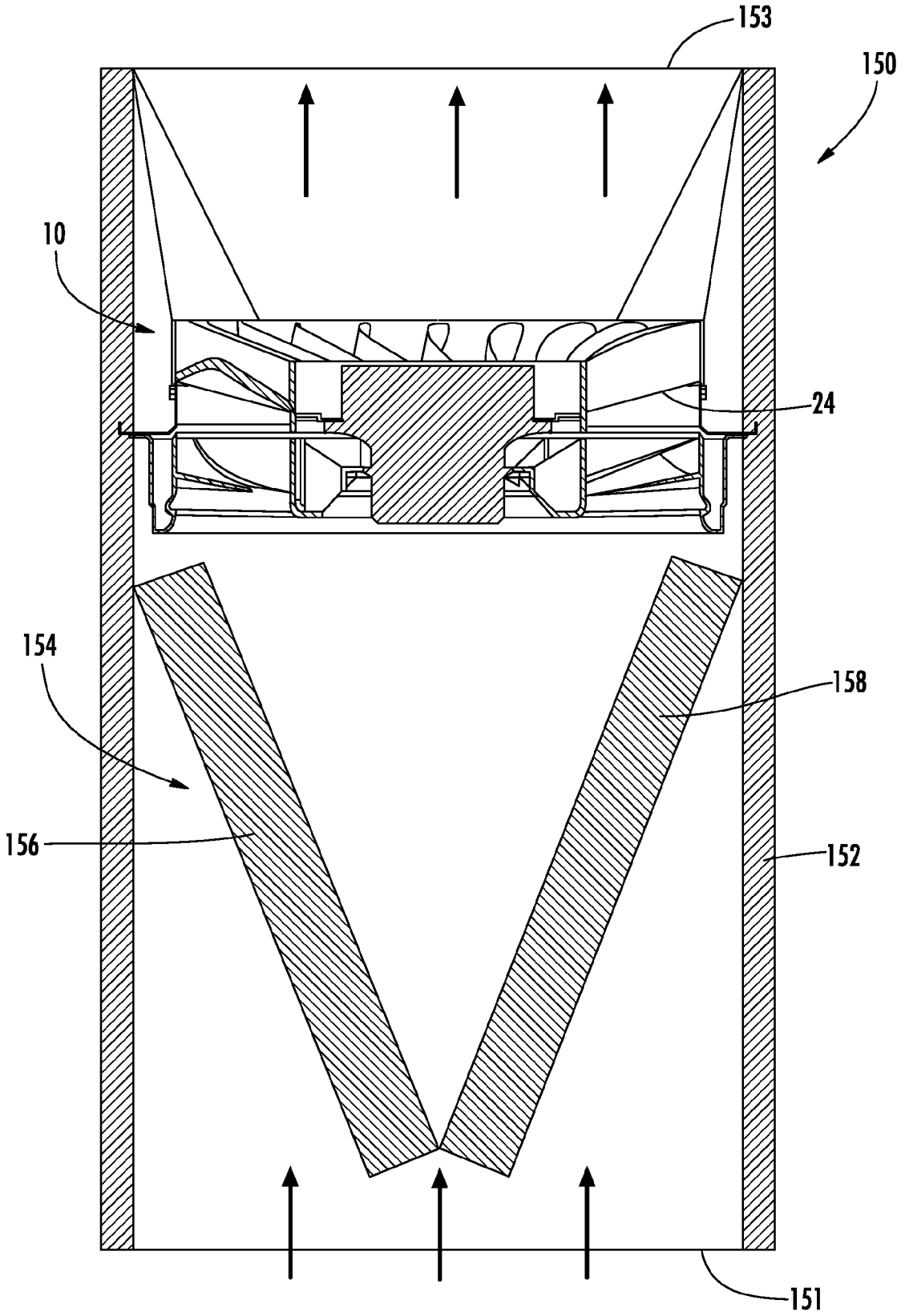
FIG. 11 is a cross-section of air handling unit of an air conditioning system according to another embodiment of the invention.
Figure 12:
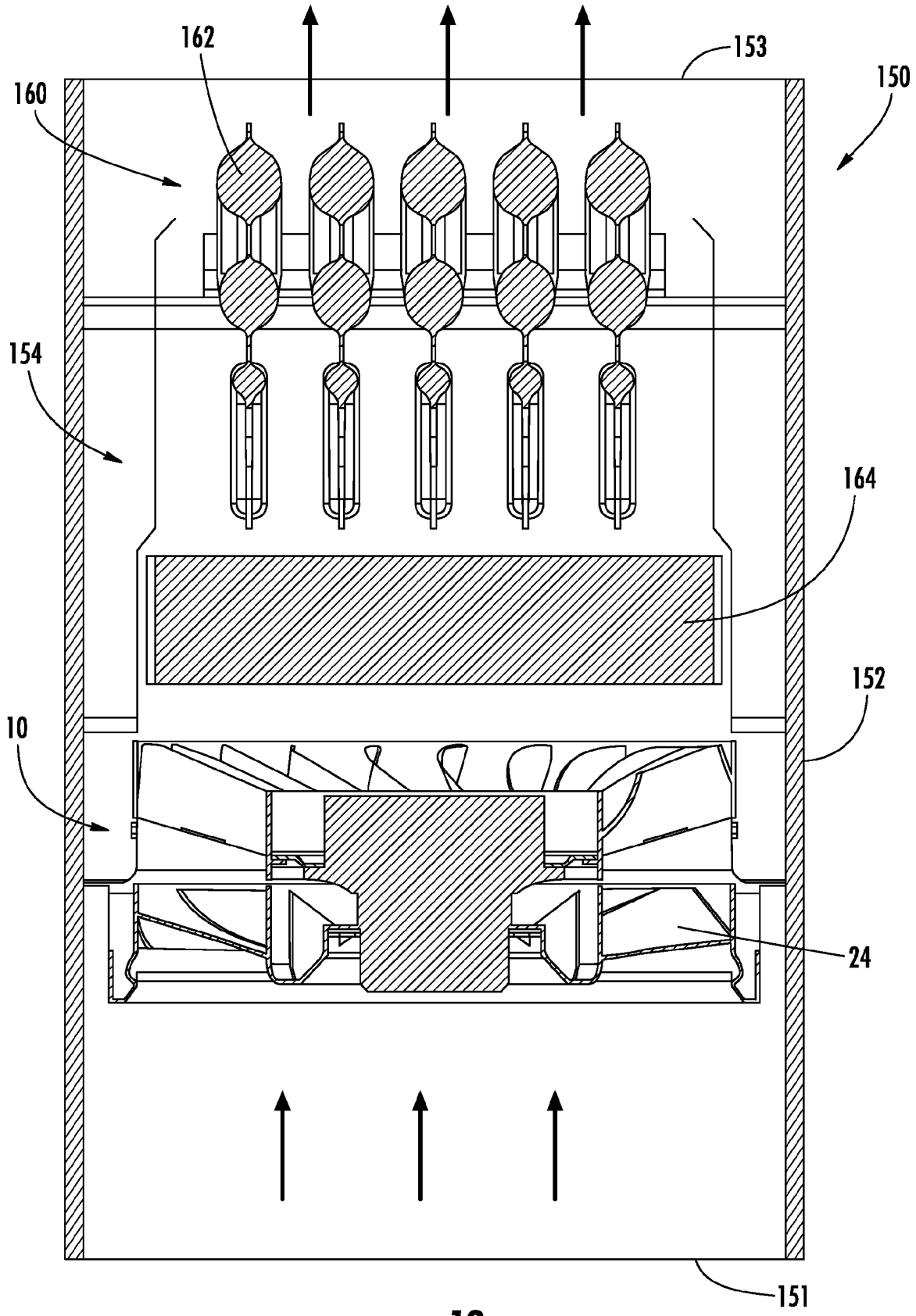
FIG. 12 is a cross-section of air handling unit of an air conditioning system according to another embodiment of the invention.

Referring now to FIGS. 10-12, an air handling unit 150 of an air conditioning system is illustrated. Exemplary air conditioning systems include split, packaged, and rooftop systems, for example. The air being heated or cooled in the air handling unit 150 may be provided from a return air duct connected to a space to be conditioned or alternatively may be fresh air drawn in from an outside source. The air handling unit 150 includes a housing duct or cabinet 152 within which various components are located. For example, housed within the housing duct 152 of the air handling unit 150 is a heat exchanger assembly 154 configured to heat or cool the surrounding air and a fan 10 that circulates air through the heat exchanger assembly 154. Depending on the desired unit characteristics, the fan assembly 10 may be positioned either downstream with respect to the heat exchanger assembly 154 (i.e. a "draw through" configuration), as shown in FIGS. 10 and 11, or upstream with respect to the heat exchanger assembly 154 (i.e. a "blow through" configuration) as in FIG. 12. The housing duct 152 includes a lower duct connector 151 and an upper duct connector 153 that define inlet and outlet openings.

In embodiments where the air handling unit 150 cools the air flowing there through, such as when the air handling unit 150 is a fan coil unit for example, the heat exchanger assembly 154 may be one of a plurality of configurations. As illustrated in FIG. 10, the heat exchanger assembly 154 is a single heat exchanger coil 156 arranged at an angle with respect to the flow path of air through the housing duct 152. Alternative heat exchanger configurations include a first heat exchanger coil 156 and a second heat exchanger coil 158 arranged in a generally V-shaped configuration (FIG. 11) or a generally A-shaped configuration, as is known in the art. In such embodiments, the heat exchanger assembly 154 is configured to absorb heat from the air passing through the heat exchanger assembly 154 such that cool air is provided at the outlet opening 153 of the housing duct 152.

In embodiments where the air handling unit 150 is configured to heat the air, such as when the air handling unit 150 is a furnace for example (FIG. 12), the heat exchanger assembly 154 typically includes a vertically arranged primary heat exchanger 160 coupled to a secondary heat exchanger 164. A burner assembly (not shown) connected to an inlet 162 of the primary heat exchanger 160 creates a heating fluid, such as flue gas for example. The heating fluid flows through both the primary heat exchanger 160 and the secondary heat exchanger 164. Heat from the heating fluid is transferred to the air circulating through the heat exchanger assembly 154 such that the air discharged from the outlet opening 153 of the housing duct 152 is warmer than the air entering the housing duct 152 at the inlet opening 151.

The fan 10 is positioned within the housing duct 15 such that a discharge end 13 of the fan 10 is arranged generally perpendicular to the flow F of air through the housing duct 152. The fan assembly 30 includes an impeller 42 whose axis of rotation is substantially aligned with the flow path F of the air such that the circulating air travels generally linearly through the fan 10. In one embodiment, the fan assembly 30 includes a vane-axial fan. The in-line fan 10 is mounted within the housing duct 152 such that the air circulating through the housing duct 152 travels through the fan 10 and not between an outer periphery of the fan 10 and a portion of the housing duct 152. Use of an in-line fan 10 significantly reduces the turning losses in the air handling unit 150 such that a fan power reduction of up to about 50% may be achieved. In addition, the compact envelope of an in-line fan 10 allows the height of the air handling unit 150 to be reduced.

In one embodiment, the fan 10 is positioned within the housing duct 152 such that the air entering the inlet 11 of the fan 10 is relatively cool. Referring again to the air handling units 150 of FIGS. 11 and 12, the illustrated fan 10 is positioned downstream from the heat exchanger assembly 154. The fan 10 is configured to draw warm air from the inlet opening 151 of the housing duct 152 through the heat exchanger assembly 154. The heat exchanger assembly 154 absorbs heat from the air such that the air leaving the heat exchanger assembly 154 and entering the in-line fan 10 has been cooled. This cool air passes linearly through the fan 10 to a conduit (not shown) coupled to the outlet opening 153 of the housing duct 152. The fan 10 is positioned upstream from the heat exchanger assembly 154 in the air handling unit 150 illustrated in FIG. 12. Cool air entering the inlet opening 151 of the housing duct 152 travels linearly through the fan 10 and is blown into the heat exchanger assembly 154. After being heated by the heat exchanger assembly 154, the air is then circulated to a conduit (not shown) coupled to the outlet opening 153 of the housing duct 152 to be distributed.

Referring now to FIGS. 1-9, an exemplary vane-axial flow fan 30 is illustrated in more detail. The fan 10 may be driven by an electric motor 12 connected to the fan 10 by a shaft (not shown), or alternatively a belt or other arrangement. In operation, the motor 12 drives rotation of the fan 10 to urge airflow 16 across the fan 10 and along a flow path 18, for example, from a heat exchanger (not shown). The fan 10 includes a casing 22 with a fan rotor 24, or impeller rotably located in the casing 22. Operation of the motor 12 drives rotation of the fan rotor 24 about a fan axis 26. The fan rotor 24 includes a plurality of fan blades 28 extending from a hub 30 and terminating at a fan shroud 32. The fan shroud 32 is connected to one or more fan blades 28 of the plurality of fan blades 28 and rotates about the fan axis 26 therewith. In some embodiments, the fan 10 further includes a stator assembly 72 including a plurality of stator vanes 74, located either upstream or downstream of the fan rotor 24. In some embodiments, the fan 10 has a hub 30 diameter to fan blade 28 diameter ratio between about 0.45 and 0.65. Further the fan 10 nominally operates in a rotational speed between about 1500 RPM and about 2500 RPM with a fan blade 28 tip speed of about 0.1 Mach or less.

Figure 1:
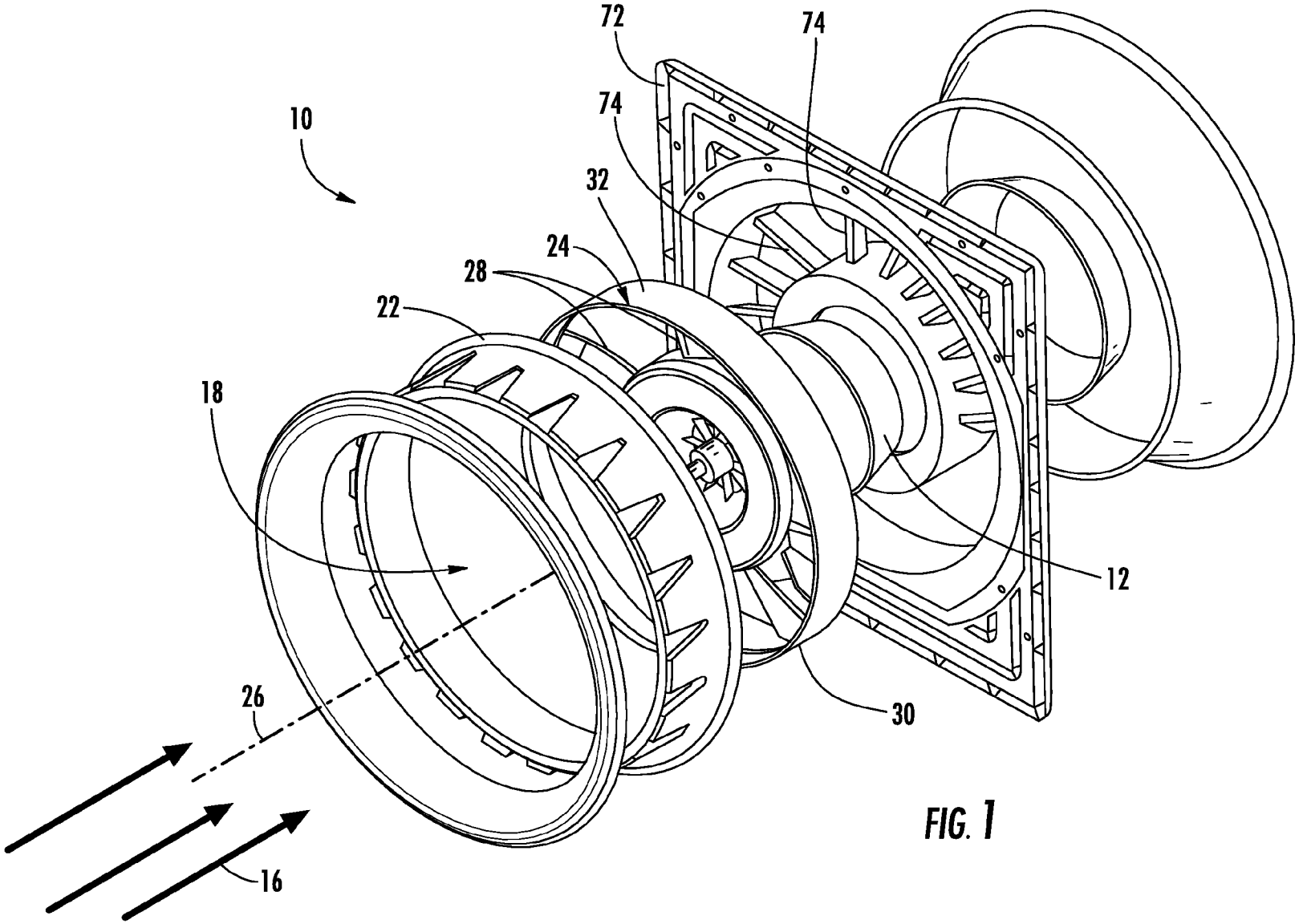
FIG. 1 is a perspective view of an embodiment of a fan assembly.
Figure 2:
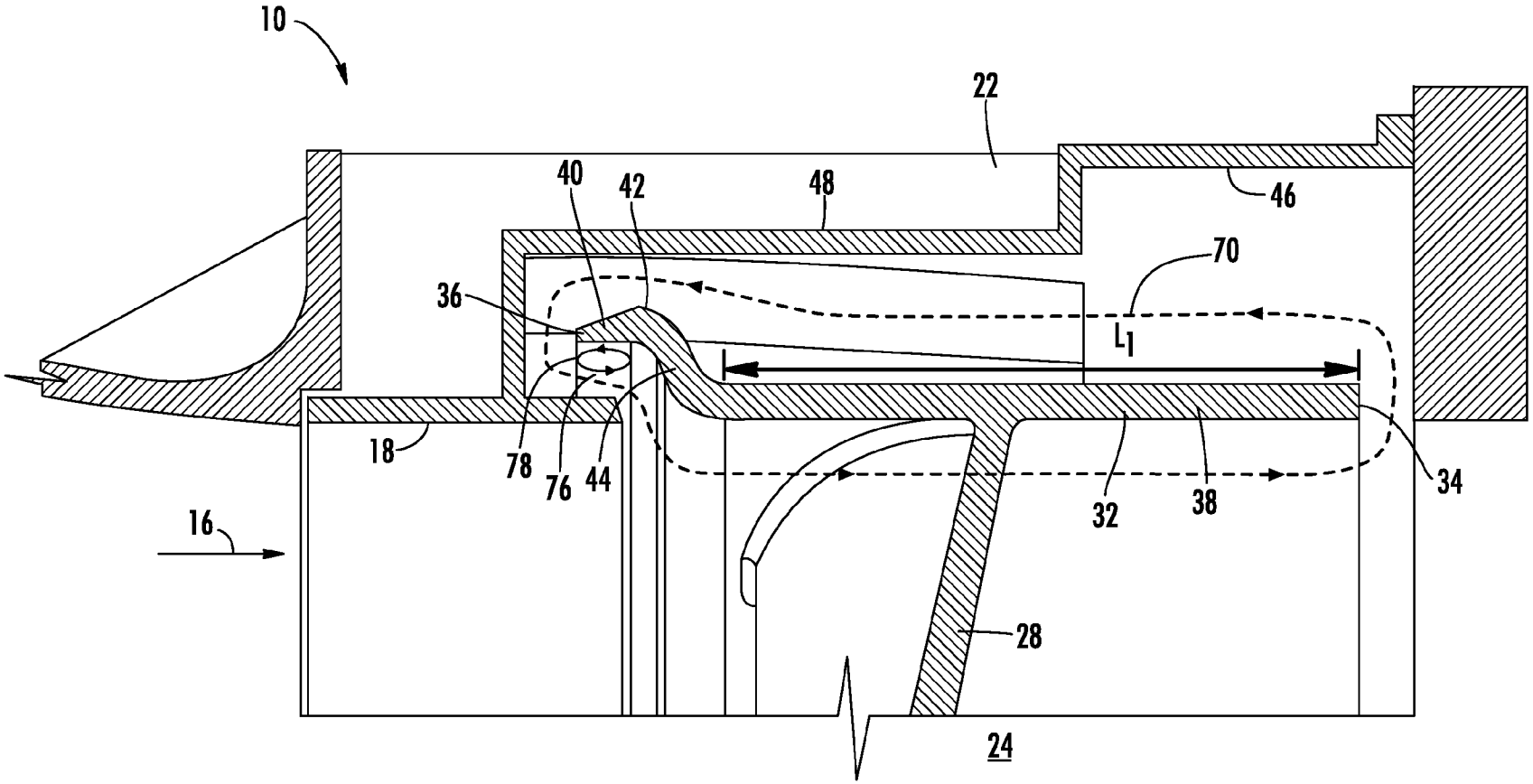
FIG. 2 is a partial cross-sectional view of an embodiment of a fan assembly illustrating a fan shroud and casing interface.
Figure 2A:
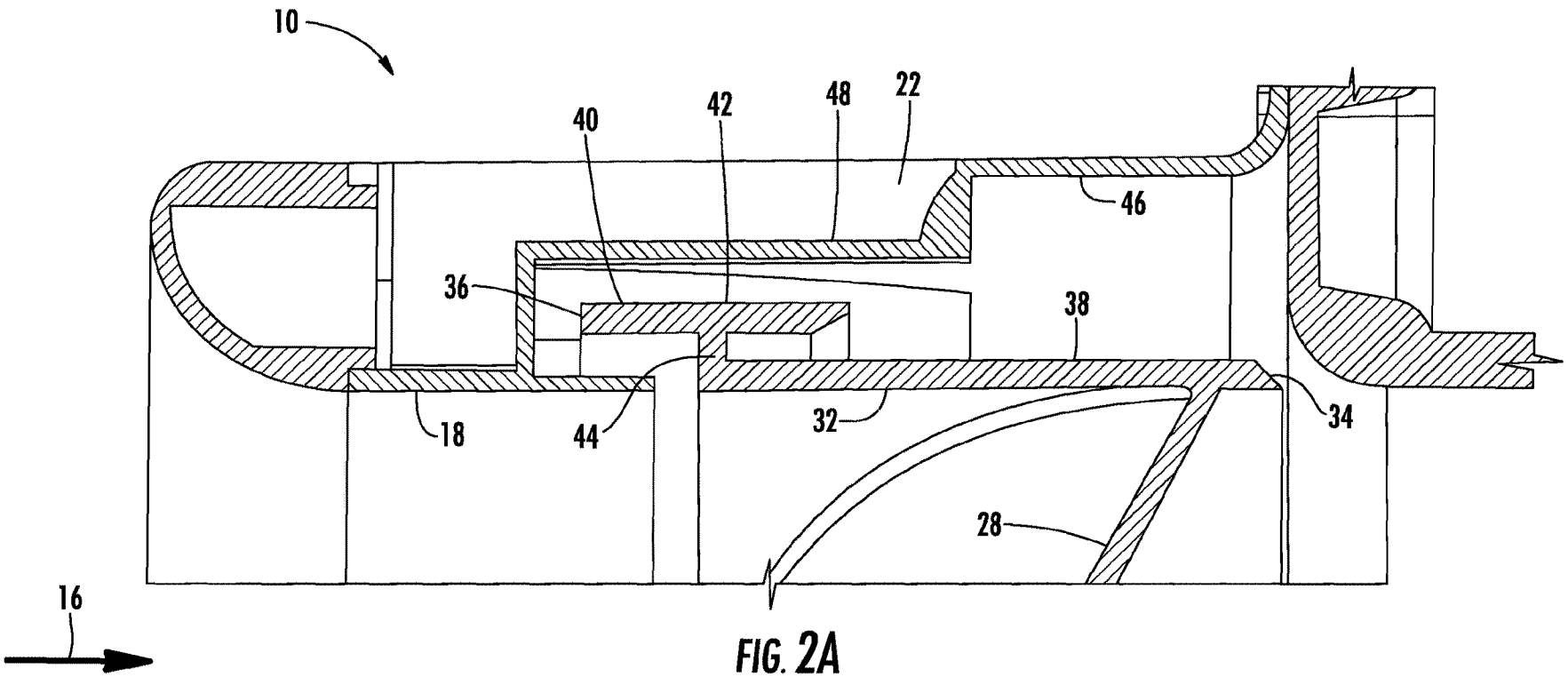
FIG. 2A is a partial cross-sectional view of another embodiment of a fan assembly illustrating a fan shroud and casing interface.
Figure 2B:
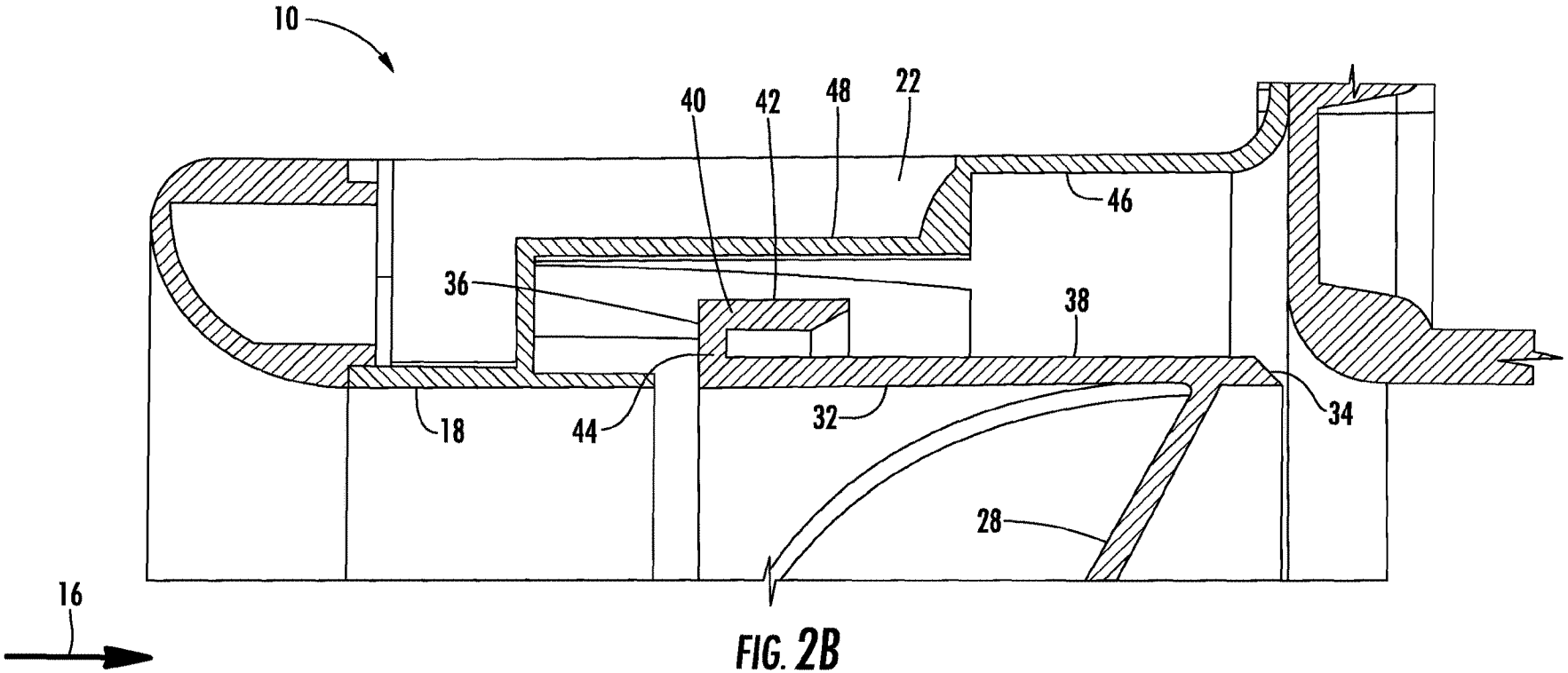
FIG. 2B is a partial cross-sectional view of yet another embodiment of a fan assembly illustrating a fan shroud and casing interface.

Referring to FIG. 2, the fan shroud 32 defines a radial extent of the fan rotor 24, and defines running clearances between the fan rotor 24, in particular the fan shroud 32, and the casing 22. During operation of the fan 10, a recirculation flow 70 is established from a downstream end 34 of the fan shroud 32 toward an upstream end 36 of the fan shroud 32, where at least some of the recirculation flow 70 is reingested into the fan 10 along with airflow 16. This reingestion may be at an undesired angle or mass flow, which can result in fan instability or stall. To alleviate this, the fan shroud 32 extends substantially axially from the downstream end 34 of the fan shroud 32 toward the upstream end 36 of the fan shroud 32 along a first portion 38 for a length $L_1$, which may be a major portion (e.g. 80-90%) of a total shroud length $L_{tot}$. The first portion 38 of the fan shroud 32 is connected to the fan blades 28. A second portion 40 of the fan shroud 32 also may extend in an axial direction, but is offset radially outwardly from the first portion 38, and defines a maximum radius 42 of the fan shroud 32. A third portion 44 connects the first portion 38 and the second portion 40. In some embodiments, as shown in FIG. 2, this results in a substantially s-shaped cross-section of the fan shroud 32. In other embodiments, for example, as shown in FIGS. **2*a*-2*b*, the resulting cross-section is T-shaped and J-shaped, respectively. During operation, the fan shroud 32 forms a separation bubble 76 of flow between the upstream end 36 and the casing 22. This separation bubble 76 is a small recirculation zone that creates an effectively smaller running clearance gap 78 between upstream end 36 and casing 22, thereby limiting the amount of recirculation flow 70 through the running clearance gap 78**.

The casing 22 includes a casing inner surface 46, which in some embodiments is substantially cylindrical or alternatively a truncated conical shape, extending circumferentially around the fan shroud 32. Further, the casing 22 includes a plurality of casing elements, or casing wedges 48 extending radially inboard from the casing inner surface 46 toward the fan shroud 32 and axially at least partially along a length of the fan shroud 32. The casing wedges 48 may be separate from the casing 22, may be secured to the inner surface 46, or in some embodiments may be formed integral with the casing 22 by, for example, injection molding. While the description herein relates primarily to casing wedges 48, in other embodiments other casing elements, such as casing fins 148 shown in FIG. **3*a***, may be utilized.

Figure 3:
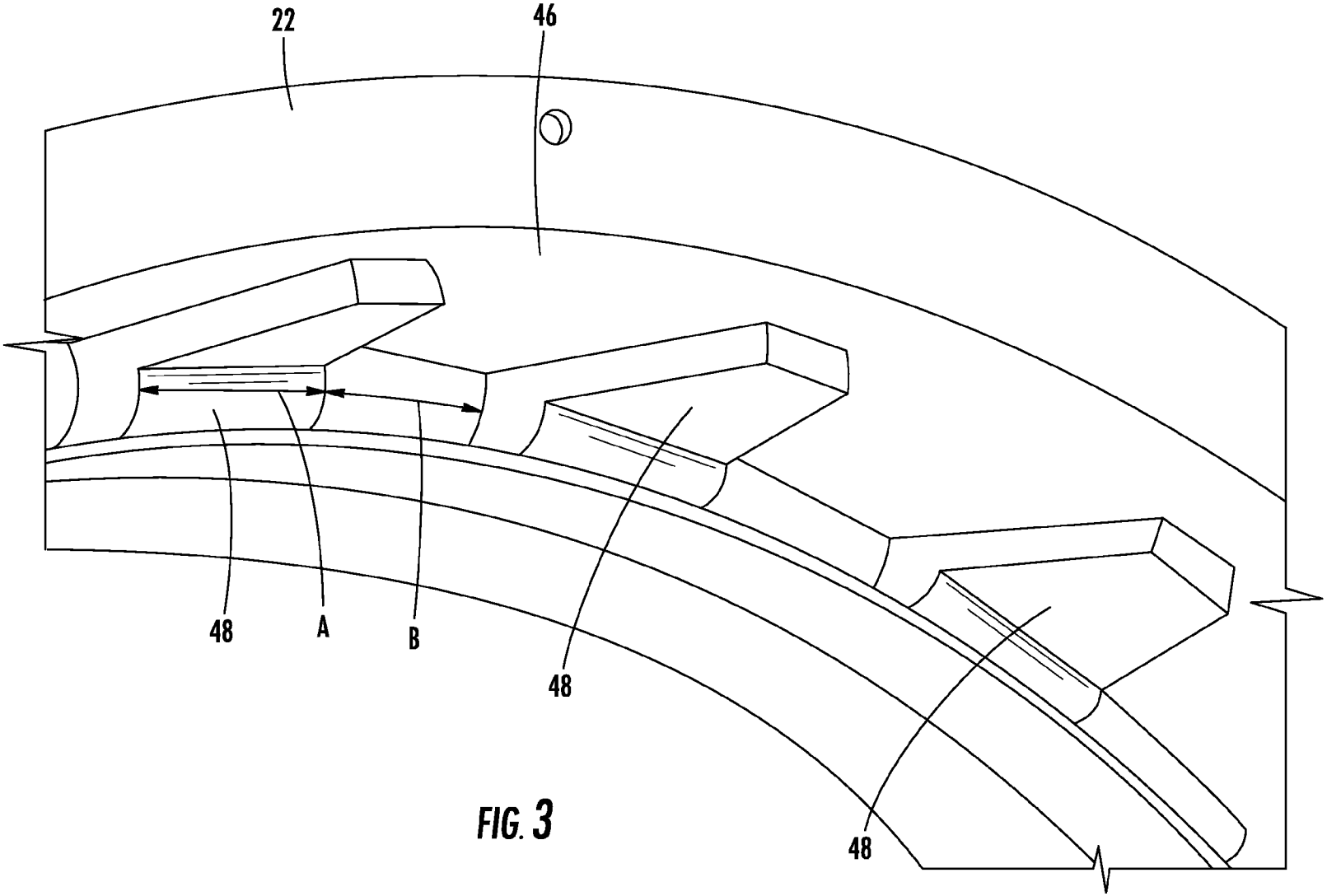
FIG. 3 is an isometric view of an embodiment of a casing for a fan assembly.
Figure 3A:
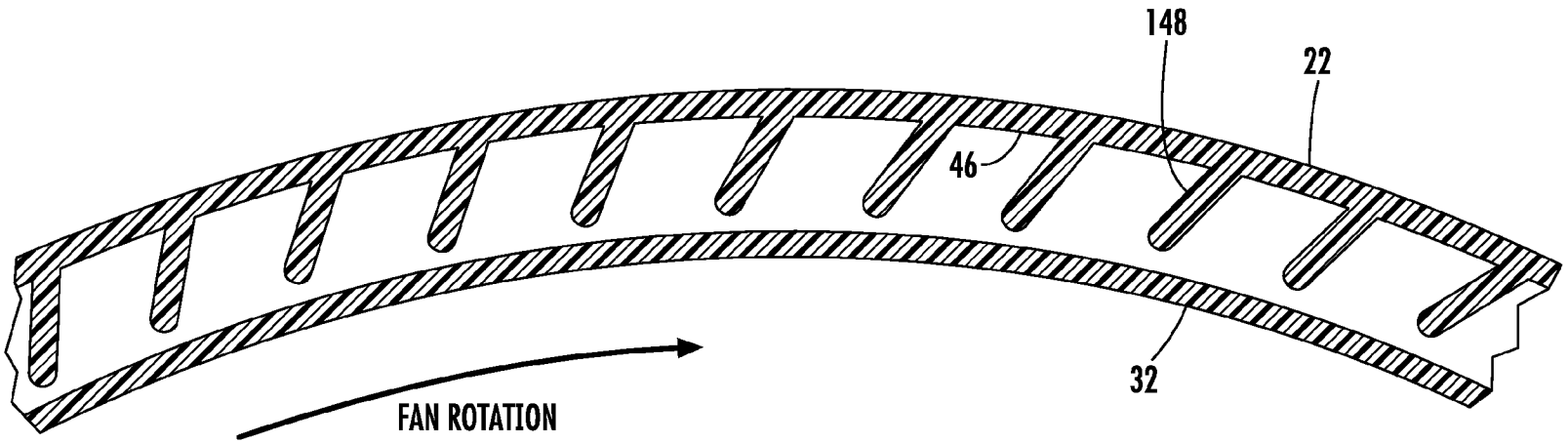
FIG. 3A is a partial cross-sectional view of another embodiment of a casing for a fan assembly.

Referring to FIG. 3, the casing wedges 48 are arrayed about a circumference of the casing 22, and in some embodiments are at equally-spaced intervals about the circumference. The number of casing wedges 48 is variable and depends on a ratio of wedge width A of each wedge to opening width B between adjacent wedges expressed as A/B as well as a ratio of wedge width A to fan shroud 32 circumference, expressed as $A/\pi D$, where D is a maximum diameter of the fan shroud 32. In some embodiments, ratio A/B is between 0.5 and 4, though may be greater or lesser depending on an amount of swirl reduction desired. In some embodiments, ratio $A/\pi D$ is in the range of about 0.01 to 0.25. Further, the number of casing wedges 48 may be selected such as not to be a multiple of the number of fan blades 28 to avoid detrimental tonal noise generation between the recirculation flow 70 emanating from the casing wedges 48 and the rotating fan blades 28. In some embodiments, the fan rotor 24 has 7, 9 or 11 fan blades 28.

Figure 4:
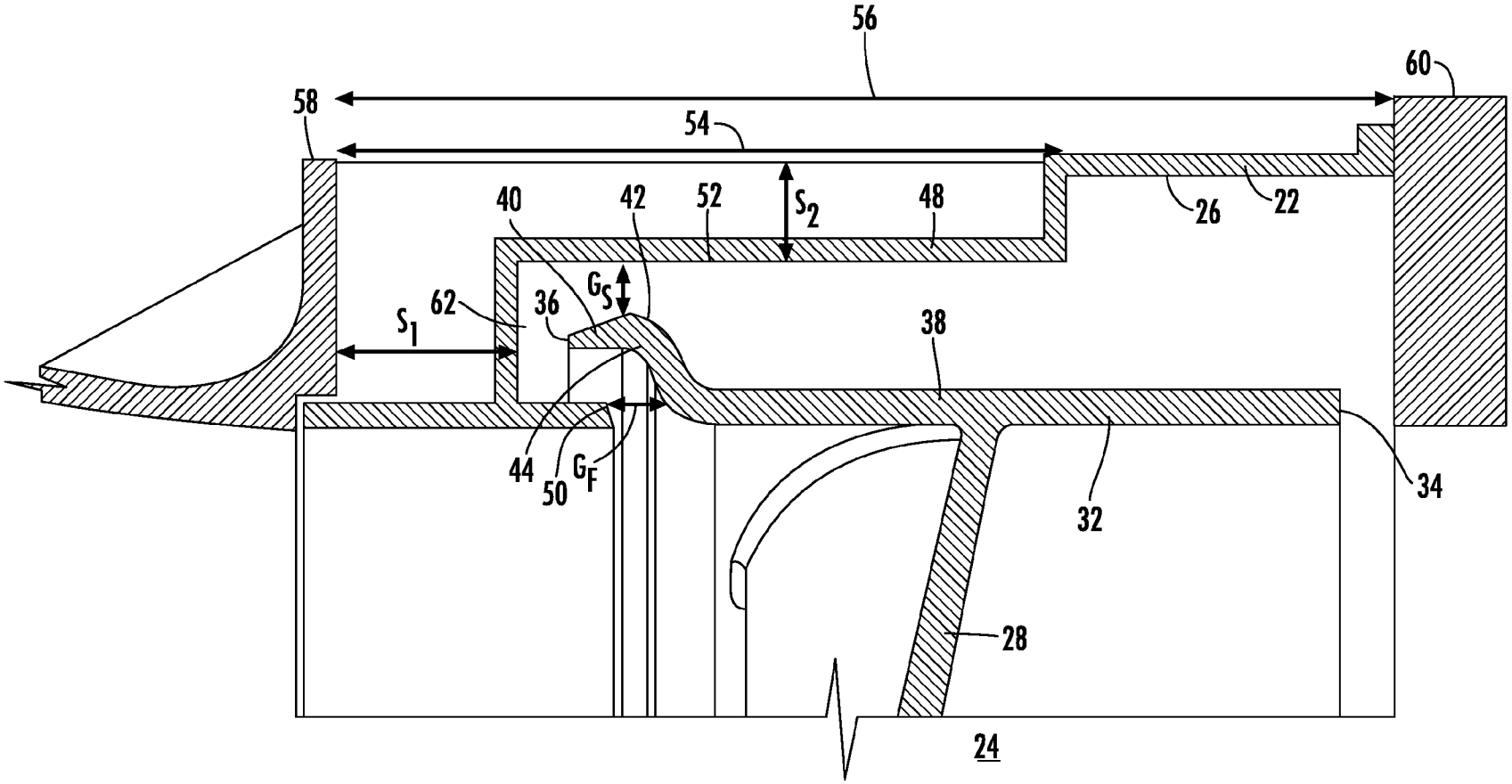
FIG. 4 is another partial cross-sectional view of an embodiment of a fan assembly illustrating a fan shroud and casing interface.

Referring again to FIG. 2, the casing wedges 48 in some embodiments are shaped to conform to and wrap around the second portion 40 of the fan shroud 32, leaving minimum acceptable running clearances between the casing wedges 48 and the fan shroud 32. Thus, as shown in FIG. 4, the casing wedges 48 result in an axial step $S_1$ from a forward end 52 of the casing 22 and a radial step $S_2$ from the casing inner surface 46 at each casing wedge 48 around the circumference of the casing 22. A magnitude of the step $S_1$ is between $1*G_F$ and $20*G_F$, where $G_F$ is an axial offset from a forward flange 50 of the casing 22 to the second portion 40 of the fan shroud 32. Similarly, a magnitude of $S_2$ is between $1*G_S$ and $20*G_S$, where $G_s$ is a radial offset from the maximum radius location 42 to a radially inboard surface 52 of the casing wedge 48. An axial wedge length 54 is between 25% and 100% of an axial casing length 56. Further, the radially inboard surface 52, while shown as a substantially radial surface, may be tapered along the axial direction such that $S_2$ decreases, or increases, along the axial wedge length 54 from an upstream casing end 58 to a downstream casing end 60. A forward wedge surface 62, which defines $S_1$, while shown as a flat axial surface, may be similarly tapered such that $S_1$ decreases, or increases or both, with radial location along the forward wedge surface 62. In other embodiments, forward wedge surface 62 may have a curvilinear cross-section.

Figure 4A:
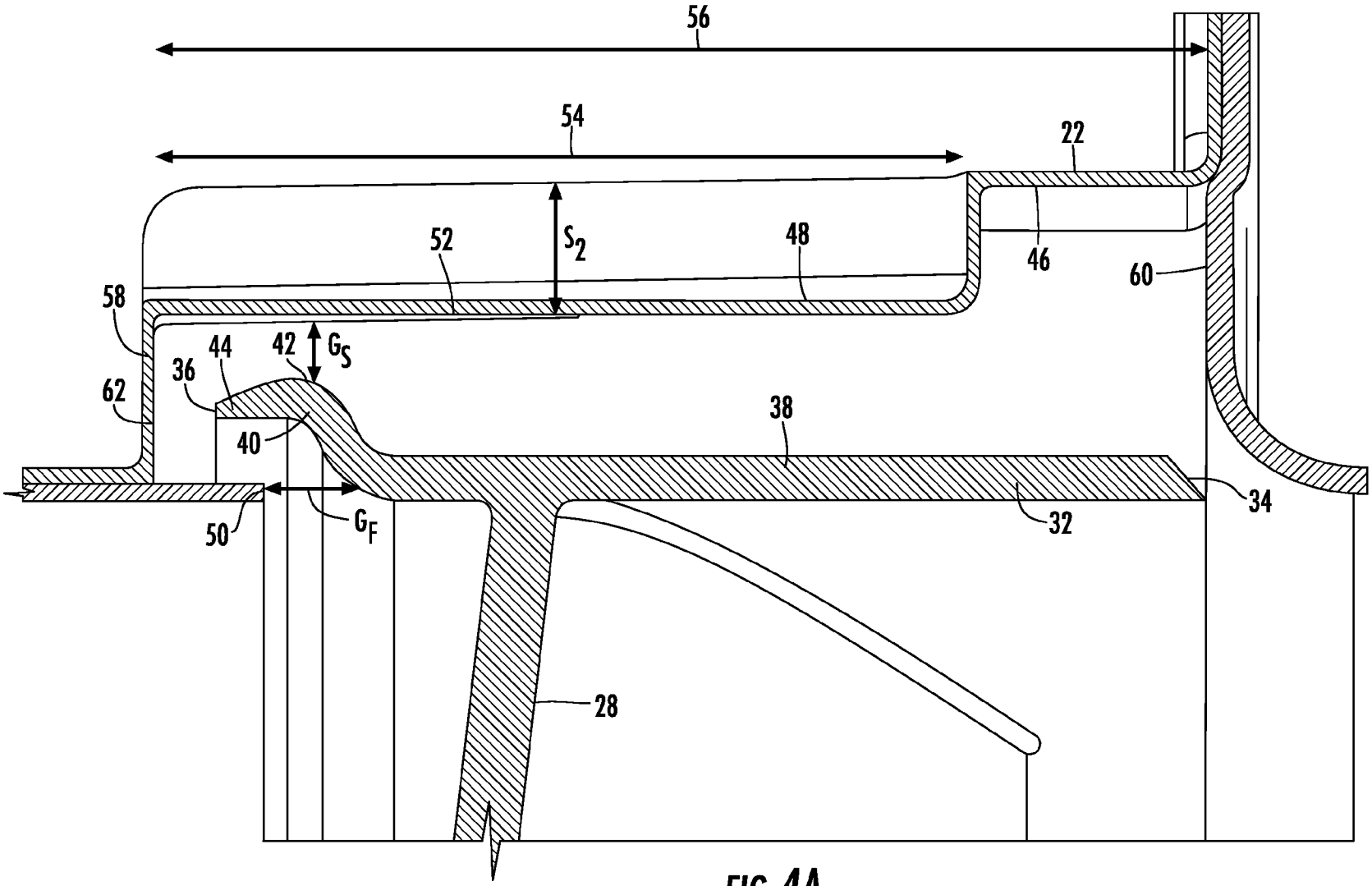
FIG. 4*a* is a partial cross-sectional view of another embodiment fan assembly illustrating a fan shroud and casing interface.

Referring to FIG. 4*a*, the forward wedge surface 62 of some embodiments may coincide with the forward casing surface 58. In such cases, the forward axial step S1 is zero. The forward casing surface 58 may be a constant radial surface or may be a curvilinear surface.

Figure 5:
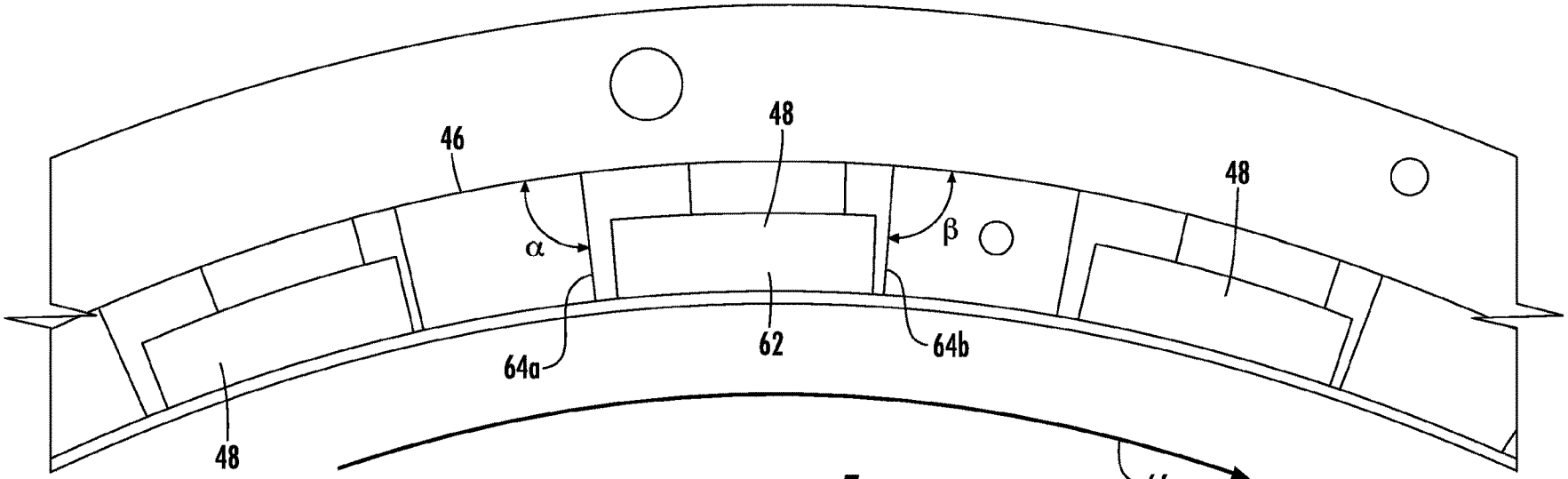
FIG. 5 is another upstream-facing cross-sectional view of an embodiment of a rotor casing illustrating angles formed between casing wedge sides and tangents to the casing.

Referring to FIG. 5, wedge sides 64*a* and 64*b* of the casing wedges 48 form angles α and β, respectively at an intersection with a tangent of the casing inner surface 46, where side 64*a* is a leading side relative to a rotation direction 66 of the fan rotor 24 and 64*b* is a trailing side relative to the rotation direction 66. In some embodiments, α and β are in the range of 30° and 150° and may or may not be equivalent, complimentary or supplementary. The wedge sides 64*a* and 64*b* may be, for example, substantially planar as shown or may be curvilinear along a radial direction.

Figure 6:
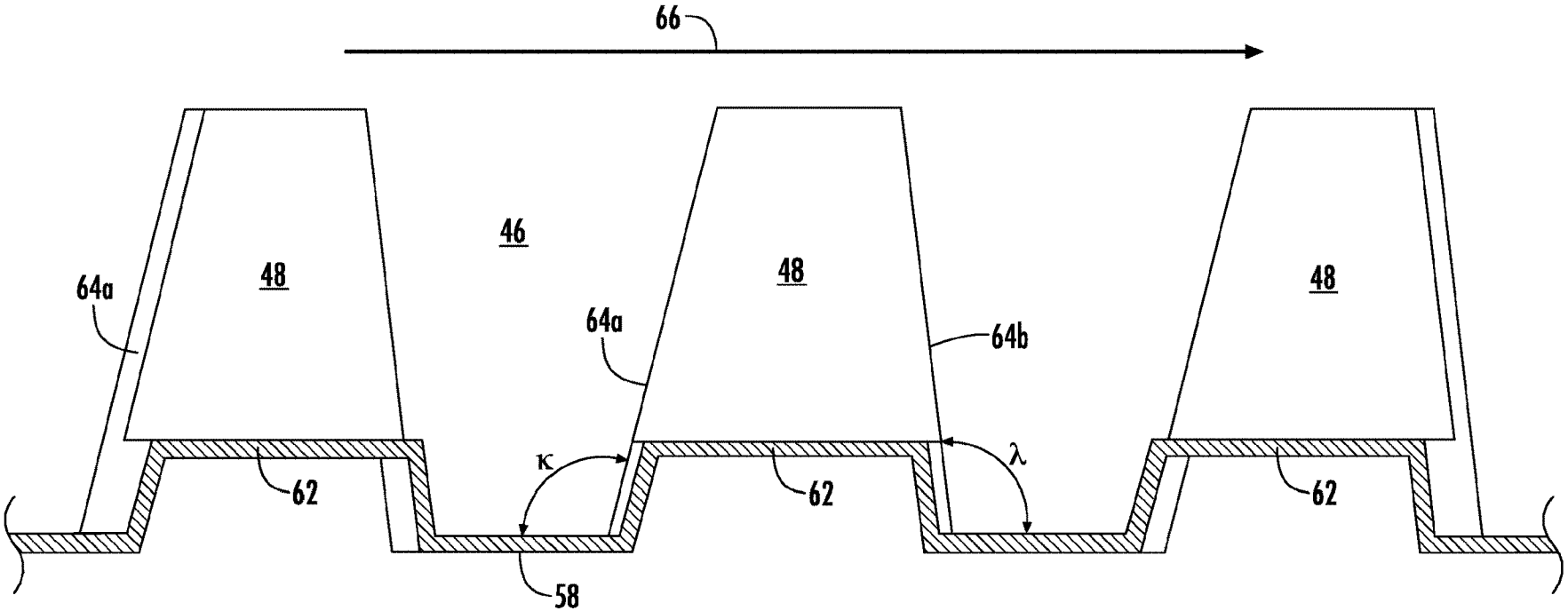
FIG. 6 is a plan view of an interior of an embodiment of a casing.

Referring to FIG. 6, in the axial direction, wedge sides 64*a* and 64*b* form angles K and λ respectively with the upstream casing end 58. In some embodiments, K and λ are between 90° and 150°, while in other embodiments, K and λ may be less than 90°. In embodiments where the casing wedges 48 are co-molded with the casing 22, K and λ greater than 90° are desired to enable the use of straight pull tooling. With other manufacturing methods, however, K and λ of less than 90° may be desirable. Angles K and λ may or may not be equivalent, supplementary or complimentary. Further, while the wedge sides 64*a* and 64*b* are depicted as substantially planar, they may be curvilinear along the axial direction.

Selecting angles α, β, K, and λ and axial and radial steps $S_1$ and $S_2$ as well as gaps $G_F$ and $G_S$ allows a reinjection angle of the recirculation flow 70 and a mass flow of the recirculation flow 70 to be selected and controlled.

Figure 7:
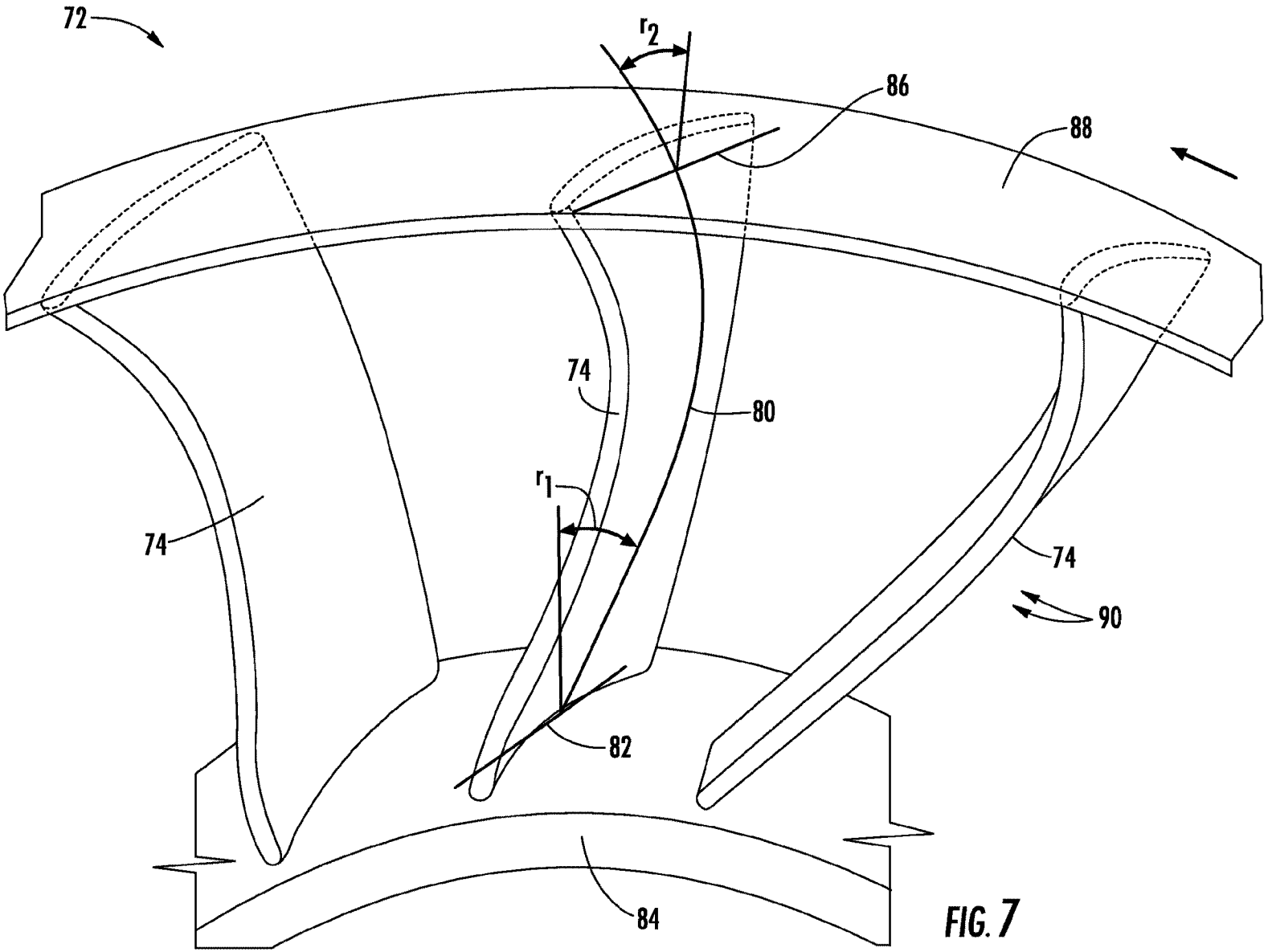
FIG. 7 is a perspective view illustrating an embodiment of circumferentially swept stator vanes.
Figure 8:
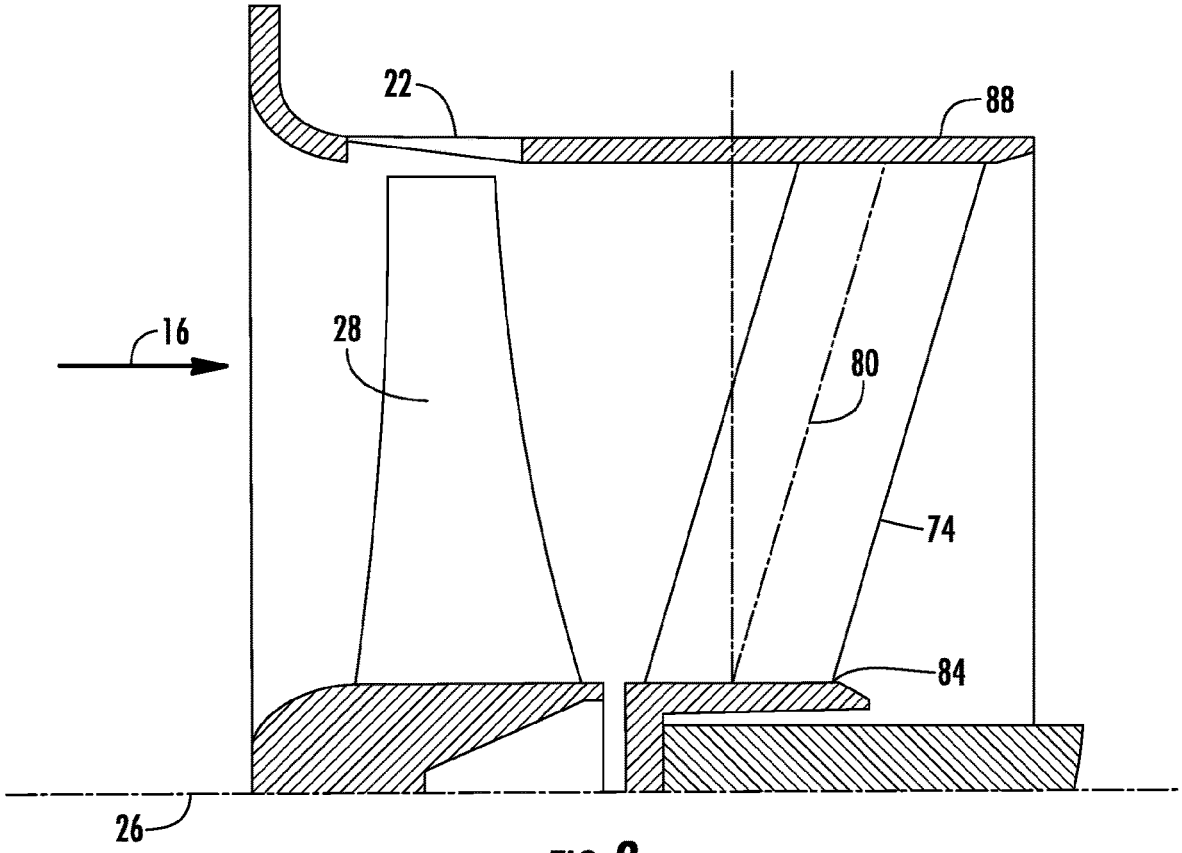
FIG. 8 is a cross-sectional view illustrating an embodiment of axially swept stator vanes.

Referring now to FIGS. 7 and 8, in some embodiments, the stator vanes 74 are positioned to include lean or sweep in a circumferential and/or axial direction. The stator vanes 74 straighten flow 16 exiting from the fan rotor 24, transforming swirl kinetic energy in the flow 16 into static pressure rise across the stator vanes 74. As shown in FIG. 7, each vane 74 has a stacking axis 80 that extends from a vane base 82 at a stator hub 84 outwardly to a vane tip 86 at a stator shroud 88. At the vane base 82, the stacking axis 80 leans circumferentially from a radial direction at an angle r1 of about 10 degrees to about 25 degrees toward a swirl direction 90 of the flow 16. This degree of lean continues for about 75% of vane 74 span, where it changes direction to lean away from the swirl direction 90 at an angle r2 of about 20 degrees to about 40 degrees. Further, as shown in FIG. 8, the vanes 74 include an axial sweep of the stacking axis 80. This axial sweep results in a reduced level of rotor-stator interaction noise, while maintaining aerodynamic performance characteristics of the fan 10.

Figure 9:
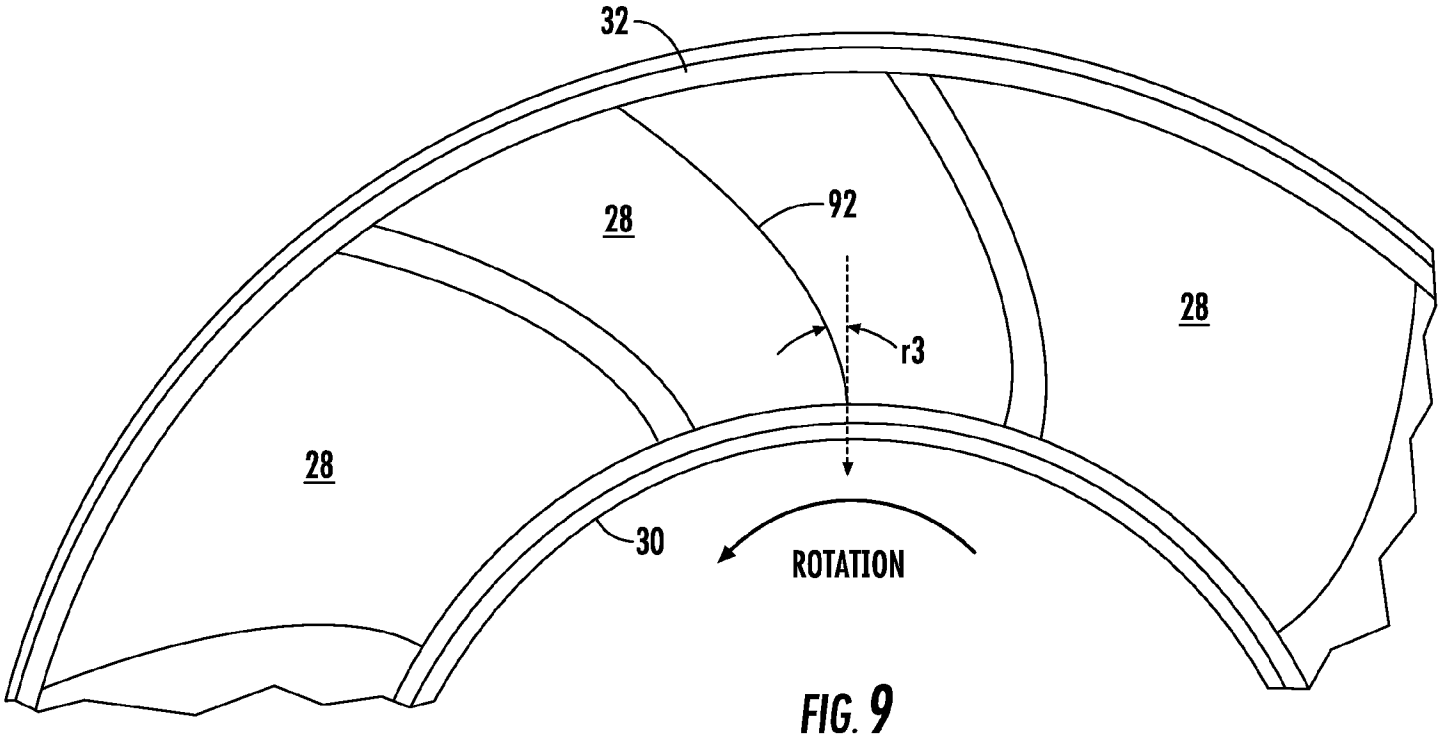
FIG. 9 is a perspective view illustrating an embodiment of circumferentially swept fan blades.

Referring now to FIG. 9, in some embodiments, the fan blades 28 include circumferential lean or sweep. Each fan blade 28 has a blade stacking axis 92 that leans circumferentially from a radial direction at an angle r3 between −60 degrees and +60 degrees. Circumferential fan blade 28 sweep is used to selectively drive flow inboard or outboard along the blade span to provide the desired rotor outflow profile to be seen by the stator vanes 74. Using this technique, multiple fan blade 28 designs can be produced in which the operating range of the rotor-stator combination is shifted to either lower or higher volume flow rates while using the same stator vane 74 design. Here, the circumferential fan blade 28 lean is tailored to produce the correct rotor outflow profile, thereby allowing the stator vanes 74 to still operate effectively. The fan blade 28 may be swept circumferentially forward into the incoming flow 16 to drive flow inboard to the rotor hub 30, may be swept circumferentially rearward to drive flow outboard to the tip region of the fan blade 28, or may be swept circumferentially in a combination of the two to migrate flow within the blade passage as desired, with the possibility of simultaneously driving flow inboard towards the hub 30 and outboard towards the tip. The amount of circumferential fan blade 28 sweep will depend on the amount of flow migration desired for the particular application and will be dictated largely by the stator vane 74 design and the desired operating envelope. Another significant result of the use of circumferentially swept fan blades 28 is to aid in the de-phasing of the interaction between the fan blade 28 wakes and the stationary stator vanes 74, thereby reducing the noise level of the fan 10 allowing for use of fan 10 in noise-limited environments such as residential environments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air handling unit for use with an air conditioning system comprising:

a housing duct through which air is circulated;

a vane-axial flow fan disposed inside the housing duct for circulating air through the housing duct, the fan including:

an impeller having a plurality of fan blades extending therefrom and an axis of rotation arranged in-line with a flow path of the air circulating through the housing duct; and a stator assembly disposed downstream of the impeller, the stator assembly including a plurality of stator vanes extending radially from a stator hub to a stator shroud, the plurality of stator vanes configured to straighten an airflow exiting the impeller; and a heat exchanger assembly arranged within the housing duct in a heat transfer relationship with the air circulating through the housing duct;

wherein the housing duct extends continuously from a duct inlet opening located upstream of the heat exchanger relative of a direction of airflow through the air handling unit, to a duct outlet opening disposed downstream of a fan outlet of the vane-axial flow fan;

wherein the vane-axial flow fan further comprises:

a shrouded fan rotor including:

the plurality of fan blades extending from a rotor hub and rotatable about a central axis of the fan assembly; and a fan shroud extending circumferentially around the fan rotor and secured to the plurality of fan blades, the shroud having:

a first axially extending annular portion secured to the plurality of fan blades;

a second axially extending annular portion radially outwardly spaced from the first axially extending annular portion; and a third portion connecting the first and second axially extending annular portions; and a casing disposed circumferentially around the fan shroud defining a radial clearance between the casing and the fan shroud, the casing including a plurality of casing elements extending from a radially inboard surface of the casing toward the shroud and defining a radial element gap between a first element surface and a maximum radius point of the shroud and an axial element gap between a second element surface and an upstream end of the fan shroud, the plurality of casing elements extending axially forward of the upstream end of the fan shroud;

wherein the fan shroud has a T-shaped cross-section;

wherein the plurality of casing elements are circumferentially swept opposite a direction of rotation of the fan rotor.

2. The air handling unit according to claim 1, wherein the fan is positioned upstream relative to the heat exchanger assembly.

3. The air handling unit according to claim 1, wherein the fan is positioned downstream relative to the heat exchanger assembly.

4. The air handling unit according to claim 1, wherein the heat exchanger assembly is substantially A-shaped relative to the flow path of air circulating through the housing duct.

5. The air handling unit according to claim 1, wherein the heat exchanger assembly is V-shaped relative to the flow path of air circulating through the housing duct.

6. The air handling unit according to claim 1, wherein the heat exchanger assembly includes a single slab heat exchanger.

7. The air handling unit according to claim 1, wherein the heat exchanger assembly includes a secondary heat exchanger and a primary heat exchanger.

8. The air handling unit according to claim 1, wherein the heat exchanger assembly is configured to cool the air circulating through the housing duct.

9. The air handling unit according to claim 1, wherein the heat exchanger assembly is configured to heat the air circulating through the housing duct.

10. The air handling unit according to claim 1, wherein the plurality of casing elements are a plurality of fins extending radially inwardly from the casing.

11. The air handling unit according to claim 1, wherein the plurality of casing elements are a plurality of casing wedges extending radially inwardly from the casing.

12. The air handling unit according to claim 1, wherein the plurality of stator vanes have a circumferential lean or sweep along at least a portion of a stator vane span.

13. The air handling unit according to claim 1, wherein the stator vanes are fixed relative to the impeller.

14. The air handling unit of claim 12, wherein an amount of circumferential sweep is between 10 degrees and 25 degrees.

15. The air handling unit of claim 12, wherein an amount of circumferential sweep is between 20 and 40 degrees.

16. The air handling unit of claim 1, wherein the plurality of stator vanes are axially swept.

17. The air handling unit of claim 1, wherein the plurality of fan blades are circumferentially swept.

18. An air handling unit for use with an air conditioning system comprising:

a housing duct through which air is circulated;

a vane-axial flow fan disposed inside the housing duct for circulating air through the housing duct, the fan including an impeller having a plurality of fan blades extending therefrom and an axis of rotation arranged in-line with a flow path of the air circulating through the housing duct; and a heat exchanger assembly arranged within the housing duct in a heat transfer relationship with the air circulating through the housing duct, the heat exchanger including a first heat exchanger coil and a second heat exchanger coil arranged in a V-shaped configuration such that a distance between the first heat exchanger coil and the second heat exchanger coil increases as distance from the vane-axial flow fan decreases;

wherein the housing duct extends continuously from a duct inlet opening located upstream of the heat exchanger relative of a direction of airflow through the air handling unit, to a duct outlet opening disposed downstream of a fan outlet of the vane-axial flow fan;

wherein the vane-axial flow fan further comprises:

a shrouded fan rotor including:

the plurality of fan blades extending from a rotor hub and rotatable about a central axis of the fan assembly; and a fan shroud extending circumferentially around the fan rotor and secured to the plurality of fan blades, the shroud having:

a first axially extending annular portion secured to the plurality of fan blades;

a second axially extending annular portion radially outwardly spaced from the first axially extending annular portion; and a third portion connecting the first and second axially extending annular portions; and a casing disposed circumferentially around the fan shroud defining a radial clearance between the casing and the fan shroud, the casing including a plurality of casing elements extending from a radially inboard surface of the casing toward the shroud and defining a radial element gap between a first element surface and a maximum radius point of the shroud and an axial element gap between a second element surface and an upstream end of the fan shroud, the plurality of casing elements extending axially forward of the upstream end of the fan shroud;

wherein the fan shroud has a T-shaped cross-section;

wherein the plurality of casing elements are circumferentially swept opposite a direction of rotation of the fan rotor.

* * * * *